US005890484A

United States Patent [19]

Yamada

[11] Patent Number: 5,890,484

[45] Date of Patent: Apr. 6, 1999

[54] EXHAUST SYSTEM FOR KITCHENS

[76] Inventor: Yoshihiro Yamada, 68-2, Nakauzura, 4-chome, Gifu-shi, Gifu, Japan

[21] Appl. No.: 913,870

[22] PCT Filed: Feb. 29, 1996

[86] PCT No.: PCT/JP96/00478

§ 371 Date: Dec. 22, 1997

§ 102(e) Date: Dec. 22, 1997

[87] PCT Pub. No.: WO96/27768

PCT Pub. Date: Sep. 12, 1996

[30] Foreign Application Priority Data

Mar. 8, 1995 [JP] Japan ..... 7-048295

[51] Int. Cl.[6] ..... F24C 15/20

[52] U.S. Cl. ..... 126/299 R; 126/299 D; 55/DIG. 36; 454/67

[58] Field of Search ..... 126/299 R, 299 D, 126/19 R, 21 R, 300, 301; 55/DIG. 36; 454/49–51, 67

[56] References Cited

U.S. PATENT DOCUMENTS 2,825,500 3/1958 McLean ..... 126/299 D
2,828,683 4/1958 Joseph et al. ..... 126/299 D
2,886,124 5/1959 Scharmer ..... 126/299 D
3,496,704 2/1970 Bandlow ..... 126/299 D
4,418,261 11/1983 Jailor et al. ..... 126/299 D

*Primary Examiner*—James C. Yeung
*Attorney, Agent, or Firm*—Fishman, Dionne, Cantor & Colburn

[57] ABSTRACT

An exhaust device (100) for a kitchen exhaust system incorporating a range hood (11) is disclosed, which is capable of substantially reducing generation of noise while efficiently evacuating fumes from the kitchen without a suction loss. The exhaust device (100) comprises a vent box (20) communicating with an exhaust duct (40), which may be housed in the hood (11) or in a housing box (10) provided above the hood (11). The vent box (20) includes a connection enclosure (20a) in its upper portion, which converges toward the duct (40). The vent box (20) contains a pair of partitions (21) each having a tilted plate (22), which provide a pair of vent routes (23). Between the partitions (21) is provided a drive motor (31) and in each vent route (23) is provided a sirocco fan (33) driven by the motor (31) whose blades (33a) are converged toward the motor (31).

11 Claims, 5 Drawing Sheets

EXHAUST SYSTEM FOR KITCHENS

BACKGROUND OF THE INVENTION

1. Field of the Invention

This invention generally relates to an exhaust system. This invention more particularly relates to an exhaust device to expel fumes from a kitchen.

2. Prior Art

Fumes including oil particles, smoke, odor and steam as well as harmful gaseous substances are unavoidably produced in a kitchen from cooking and imperfect combustion of cooking gas. Such fumes should be immediately expelled from the kitchen to keep the air in the kitchen always clean. Otherwise, the fumes will adversely affect not only people working in the kitchen but also the gas combustion of the cooking utensil. Such fumes will also stain the kitchen walls. Japanese Patent Laid-Open Publication No. 3-274325 discloses a ventilation fan that directly sucks and exhausts fumed kitchen air. It is also widely practiced to arrange a range hood over a gas table or range to directly suck up and exhaust fumes through an exhaust pipe or duct with the help of a blower.

Naturally, an exhaust system with a range hood can more effectively suck and evacuate fumed kitchen air than a ventilation fan or fans. For this reason, a range hood is often utilized for a so-called "system kitchen." It is true that the nearer a range hood is to a gas range, the more effective the exhaustion of fumed air from a kitchen will be.

However, the use of range hoods is not without a problem; there exists a major drawback in a conventional range hood system, i.e. unpleasant noise is generated during the operation of the system. This drawback is mainly due to the relatively limited dimension of an exhaust duct opening. A range hood is generally provided with a large opening to sufficiently cover a cooking range in order to collect most, if not all, fumed air directly therefrom, while an exhaust duct connected to the range hood is generally provided with a limited dimension which is much smaller than that of the range hood opening since exhaust ducts in general must be installed through walls and above ceilings. Exhaust ducts often have a dimension as small as 15 cm across. Exhaust ducts are also destined to be bent at a number of places on their way to the exit openings. Therefore, a powerful blower must be employed to forcibly expel fumes through such a narrow and bent duct, which will naturally generate much unpleasant noise. Noises are also generated when the fumed air running in an exhaust duct hits corner walls of the duct.

Any obstructive factor or element in the ventilation route of a range hood system not only deteriorates the expellant efficiency but also generates noises. Considering the fact that an exhaust duct is made much narrower than the opening of a range hood, through which fumes are expelled from a kitchen into the open air, there has been felt a demand for an exhaust device that can powerfully suck fumes into a range hood and into an exhaust duct to expel same into the open air with a much reduced noise level.

Some kitchens are furnished with a fresh air supply system in addition to an exhaust system to cooperatively provide an improved exhaustion of fumes. For such a kitchen, an exhaust system with a capacity "400 cubic meter/h" will sufficiently do the work to exhaust much of fumed air, however, an exhaust system with a capacity "500 cubic meter/h" or so will be required even with such a kitchen to also expel most of oil containing smoke from the kitchen. Without such a fresh air supply system, a kitchen will need an exhaust system having a capacity as powerful as "700 cubic meter/h, max." to exhaust substantially all fumed air containing oil particles and smoke. Such a powerful system does not match a small duct having a dimension of only about 15 cm across. If installed, such a powerful system will generate very unpleasant noise.

So-called "sirocco fans" may be employed in an appropriate way to reduce the noise level, however, a sirocco fan including its casing generally comes in a rather large overall dimension, demanding a substantial change in designing of the whole kitchen system including the design of its range hood, which is usually not feasible without major modification to the sirocco fan itself when the limited space of a kitchen is considered.

The inventor of the present invention has made efforts to find a way to effectively and substantially eliminate such noises from a kitchen exhaust system which incorporates a range hood, and has finally arrived at the present invention.

SUMMARY OF THE INVENTION

An exhaust system of the present invention which provides an excellent solution to the foregoing drawbacks of conventional exhaust systems includes an exhaust device 100 which forcibly draws fumed air produced from cooking on a kitchen range 210 into a range hood 11 and expels same into an exhaust duct 40, the exhaust device 100 including: a vent box 20 which is installed either directly in the range hood 11 or in a housing box 10 disposed additively over the range hood 11 in fluid communication with the exhaust duct 40; and a drawer device 30 housed in the vent box 20, the vent box 20 including a connection enclosure 20*a* in its top portion, which opens to and converges toward the exhaust duct 40, further, a pair of generally vertical partitions 21 are arranged in the vent box 20, generally on the left and right of the longitudinal axis of the exhaust device 100, each having a tilted plate extending from its top edge toward a central crossline of the opening of the exhaust duct 40 to provide a pair of vent routes 23, on the left and right, both of which head toward the corresponding half portions of the exhaust duct opening 40, wherein the drawer device 30 comprises a drive motor 31 housed between the partitions 21, a pair of drive shafts 31 protruding to the left and right substantially horizontally from the drive motor 31 toward the corresponding vent routes 23 through the corresponding partitions 21, and a pair of sirocco fans 33 respectively mounted on the drive shafts 32 and respectively housed in the vent routes 23, the blades 33*a* of the sirocco fans 33 arranged to converge in overall configuration toward the drive motor 31.

As described in the above, the blades 33*a* of each sirocco fan 33 which is driven by the drive motor 31 are arranged to converge toward the drive motor 31, and the drawer device 30 is installed in the vent box 20 which communicates with the exhaust duct 40 through the connection enclosure 20*a*, the vent box 20 being either directly installed in the range hood 11 (FIG. 1), or installed in the housing box 10 which is arranged above the range hood 11 in fluid communication therewith (FIG. 6). The vent routes 23 running between the side walls of the connection enclosure 20*a* and the tilted plates 22 of the partitions 21 are directed toward the respective halves of the exhaust duct opening 40.

The function of the exhaust device 100 of the present invention is described in the following generally based on the movement of the air (fumed air) drawn up into the range hood 11.

First of all, a few advantages of the present invention are briefly explained. In FIG. 1, an exhaust device 100 is shown installed in a range hood 11 which is set up over a cooking range 210 of a system kitchen 200. The overall design of the system kitchen 200 is not adversely affected by this arrangement. The overall design of the system kitchen 200 will not be adversely affected either when the exhaust device 100 is housed in a housing box 10 installed above the range hood 11 as shown in FIG. 6. In either setting, the direct installment in the range hood 11 or installation in the housing box 10 above the range hood 11, no substantial change in design of the range hood 11 will be necessary. Even when a minor change is desired or required of the range hood 11, the space needed for setting up the range hood 11 will remain substantially unchanged. The present invention with additional advantages can still provide a compact range hood 11 as well as streamlined system kitchen 200.

Heated fumed air containing harmful gaseous substances and steam as well as oil containing smoke is unavoidably produced from cooking on the gas range 210 of the system kitchen 200. The fumed air goes up and is received by the range hood 11. The drawer device 30 of the exhaust device 100 promotes suction of the fumed air, which will be drawn into the interior of the range hood 11 as indicated by the arrowed lines in FIGS. 2 and 3, and finally expelled into the open air through the exhaust duct 40.

As explained, the fumed air is forcibly sent into the exhaust duct 40 by the drawer device 30. The function of the drawer device 30 is described in detail in the following based on the flow courses of the sucked (fumed) air. The drive motor 31 of the drawer device 30 drives the drive shafts 32 as well as the sirocco fans 33 mounted thereon. The blades 33*a* of the sirocco fans 33 "cleave" or cut the air and expel the cleft (cut) air to the rear. The drawer device 30 is housed in the vent box 20 having suction openings 24 on the right and left side walls and an exhaust opening 25 on the top. The air sucked into the range hood 11 is drawn into the vent box 20 through the suction openings 24 with the work of the sirocco fans 33 and is expelled through the exhaust opening 25 as indicated by the arrowed lines in FIGS. 2 and 3.

It should be noted that the overall configuration of the blades 33*a* of each sirocco fan 33 is truncated conic converging toward the drive motor 31 from the suction openings 24 of the vent box 20. Accordingly, it is to be understood that the flow speed or rate of the air sucked by the blades 33*a* is relatively low near the side walls of the vent box 20 where the sirocco fans 33 are wider, and relatively high near the partitions 21 where the sirocco fans 33 are narrower.

The foregoing pneumatic phenomenon of the air flow is further explained in the following. The exhaust opening 25 connected with a range duct 40 is made narrower than the main body portion of the vent box 20 as shown in FIG. 3. The "outer" air flow paths leading to the exhaust opening 25 along the inner side walls of the vent box 20 from the suction openings 24 are shorter than the "inner" air flow paths leading to the exhaust opening 25 via the partitions 21. According to the present invention, the flow rate of the air running along the inner air flow paths in the vent routes 23 is higher than the flow rate of the air running along the outer air flow paths in the vent routes 23, which provides a practically uniform flow rate anywhere in the vent routes 23 without fluctuation in air pressure or turbulence in the air flow. Thus, the overall air flow within the vent box 20 is satisfactorily smooth regardless of air flow routes in the vent box 20.

Equally important is that the connection enclosure 20*a* which converges toward the exhaust duct 40 is provided in an upper portion of the vent box 20, and that the pair of partitions 21 each having a tilted plate 22 are provided to form vent routes 23 in the vent box 20 which houses the drive motor 31, the plates 22 being inclined toward a central crossline of the exhaust duct opening 40. Those vent routes 23 are so configured, as shown in FIG. 3, as to naturally and reasonably conduct the fumed air sucked by the sirocco fans 33 toward the exhaust opening 25 from the suction openings 24 provided on the side walls of the vent box 20.

The present invention eliminates virtually all obstructive factors from the vent box 20 which would otherwise interfere with air flow in the system; rather the present invention expedites the air flow from the suction openings 24 toward the exhaust opening 25 by means of the sirocco fans 33 driven by the drive motor 31 of the drawer device 30, facilitating the drive motor 31 to function at its maximum capacity without generating unpleasant noise. The fact that two sirocco fans 33 are utilized in a well balanced way, respectively mounted on the pair of drive shafts 32 which protrude generally horizontally to the right and left from the drive motor 31 in the drawer device 30 further contributes to the reduction of noise.

The vent box 20 housing the drawer device 30 shown in FIGS. 1 and 2 is installed directly in the range hood 11. Here, the fumed air received by the range hood 11 is sucked into the vent box 20 from its suction openings 24 (FIG. 2). On the other hand, the vent box 20 shown in FIG. 6 is housed in a housing box 10, which is connected with the top of the range hood 11 in fluid communication. Here, the air received by the range hood 11 is first sucked into the housing box 10 as indicated by the arrowed lines. Then the air is sent to the vent box 20 in fluid communication with the housing box 10 through the suction openings 24, the air eventually sent to the exhaust opening 25 connected with the bottom opening of the exhaust duct 40.

Either exhaust device 100 of the present invention is capable of efficiently drawing fumed air produced around a cooking range into the range hood 11, and will not generate unpleasant noise while working, assisted by the fact that the exhaust device 100 substantially eliminates suction loss.

Either exhaust device 100 facilitates employment of an exhaust system with a capacity as high as "700 cubic meter/h" without generating much noise, therefore, a need for extra installation of an air supply system in a kitchen is virtually eliminated. No substantial change is required in designing of range hoods 11 to secure more internal room for installation of an exhaust device 100.

DETAILED DESCRIPTION OF THE PREFERRED EMBODIMENT

Figure 1:
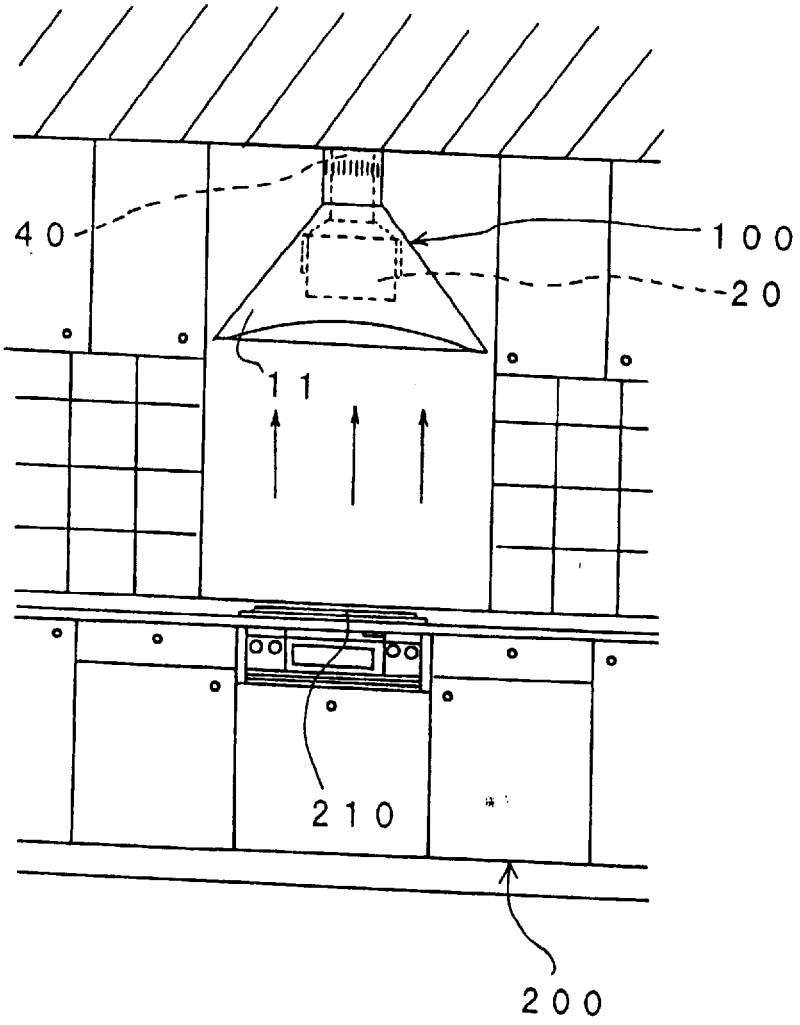
FIG. 1 is a front view showing a portion of a system kitchen which employs an exhaust device according to an embodiment of the present invention.

In FIG. 1, there is shown an exhaust device 100 according to an embodiment of the present invention as installed in a system kitchen 200. The system kitchen 200 includes a gas cooking range 210 over which is provided a range hood 11.

The range hood 11 houses a vent box 20, a feature of an exhaust device 100 of the present invention. Connected to the vent box 20 in fluid communication is an exhaust duct 40. In another embodiment of the present invention shown in FIG. 6, this vent box 20 is installed in a housing box 10 instead of the range hood 11 which is installed above the range hood 11, the housing box 10 enclosing a bottom portion of the exhaust duct 40 which is in fluid communication with the vent box 20.

Figure 2:
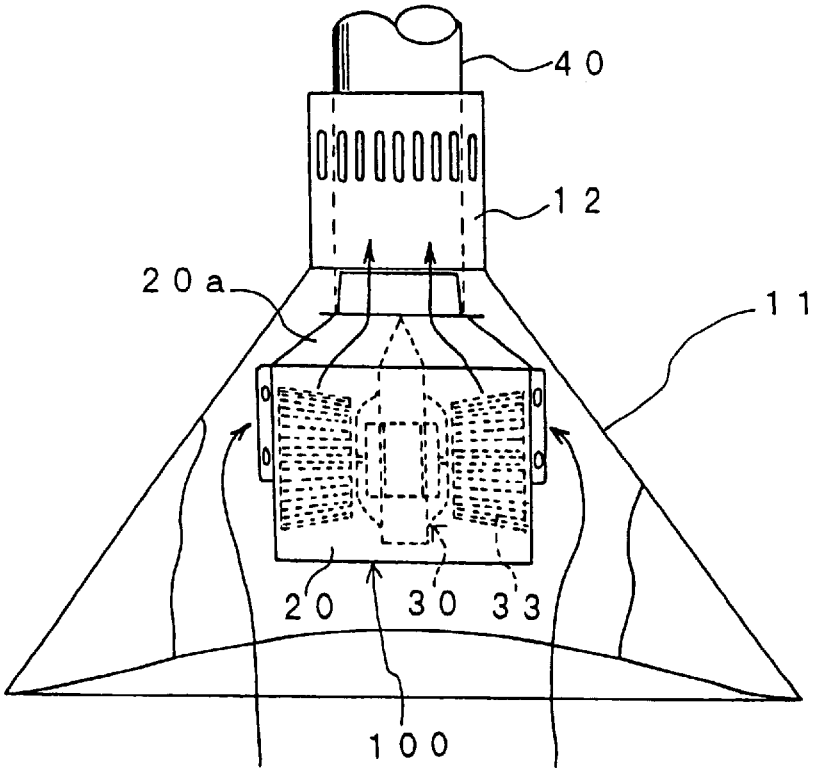
FIG. 2 is a front view of the exhaust device as installed in a range hood.
Figure 3:
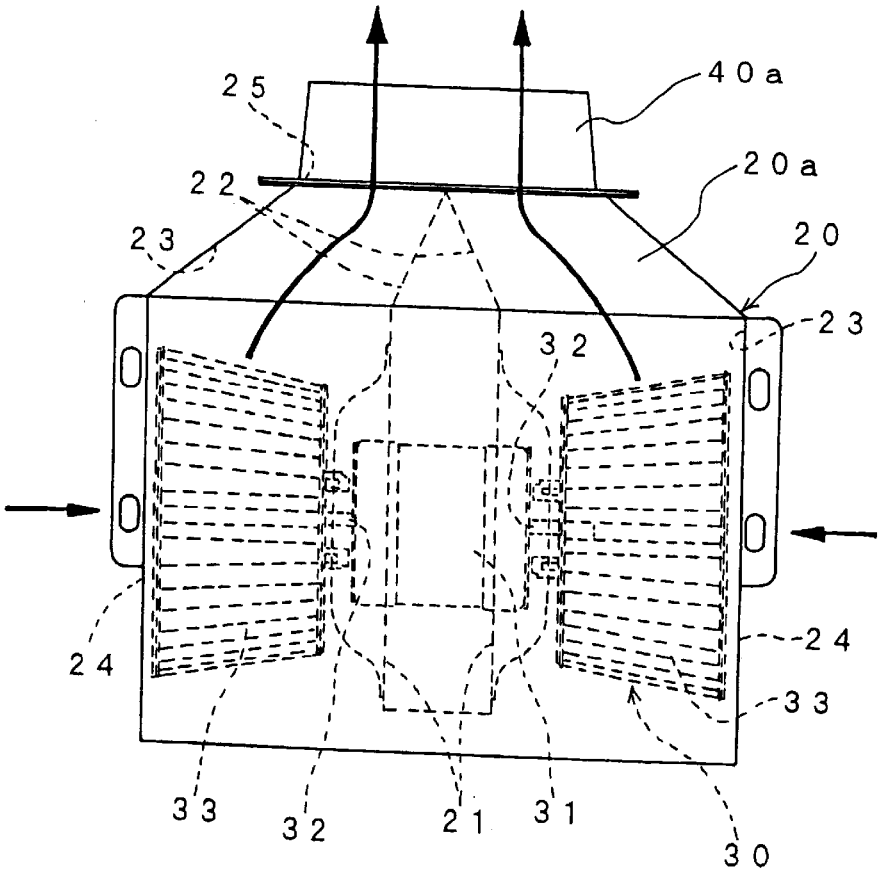
FIG. 3 is an enlarged front view showing a vent box according to the present invention as employed in the exhaust device.
Figure 4:
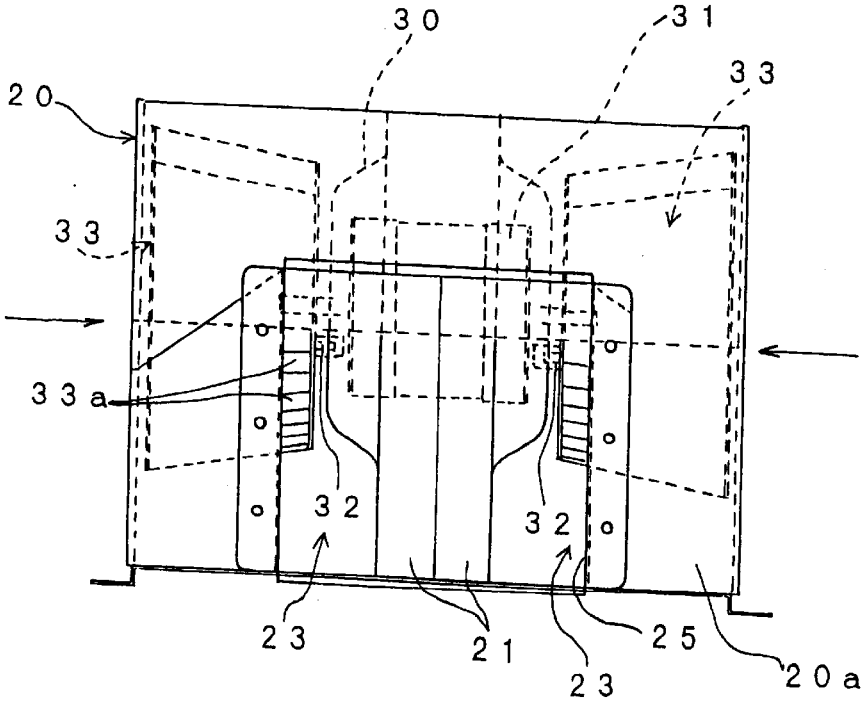
FIG. 4 is an enlarged plan view showing in detail the vent box and a drawer device housed in the vent box according to the present invention.
Figure 5:
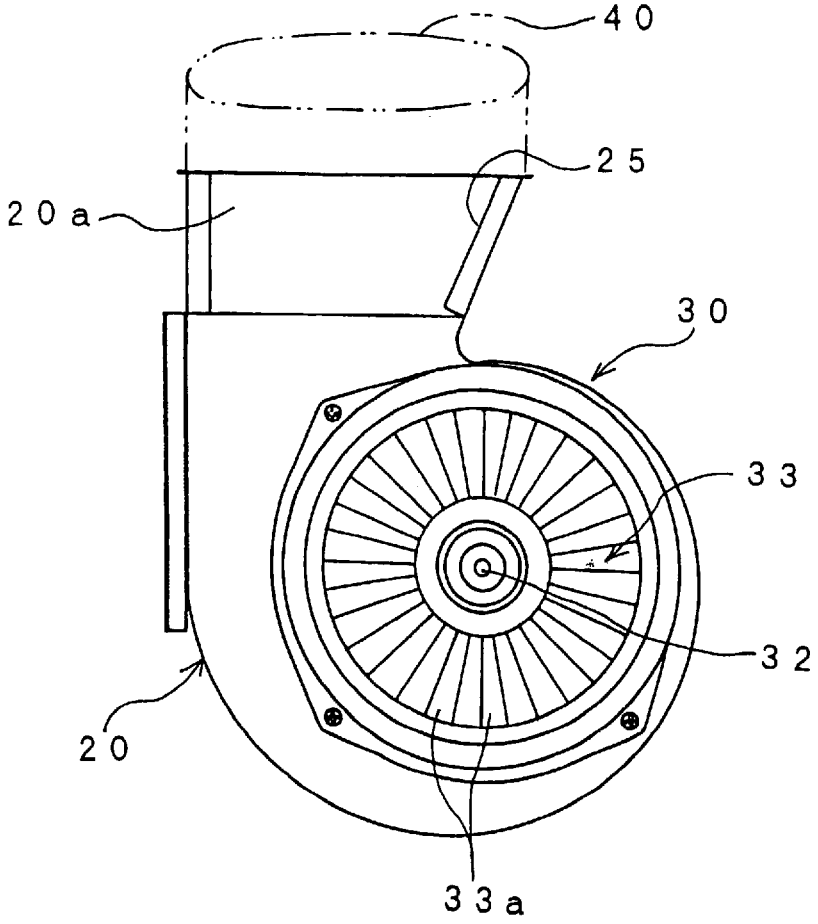
FIG. 5 is a side elevational view showing the drawer device in detail.

The vent box 20 having suction openings 24 on the right and left side walls includes in an upper portion thereof a connection enclosure 20*a* as shown in FIGS. 2–4. The connection enclosure 20*a* has an exhaust opening 25 which opens to the bottom opening of the exhaust duct 40. In the vent box 20 are also provided a pair of generally vertical partitions 21 each with a tilted plate 22 as shown in FIGS. 3 and 4 to form practically identical vent routes 23 on their left and right.

Figure 6:
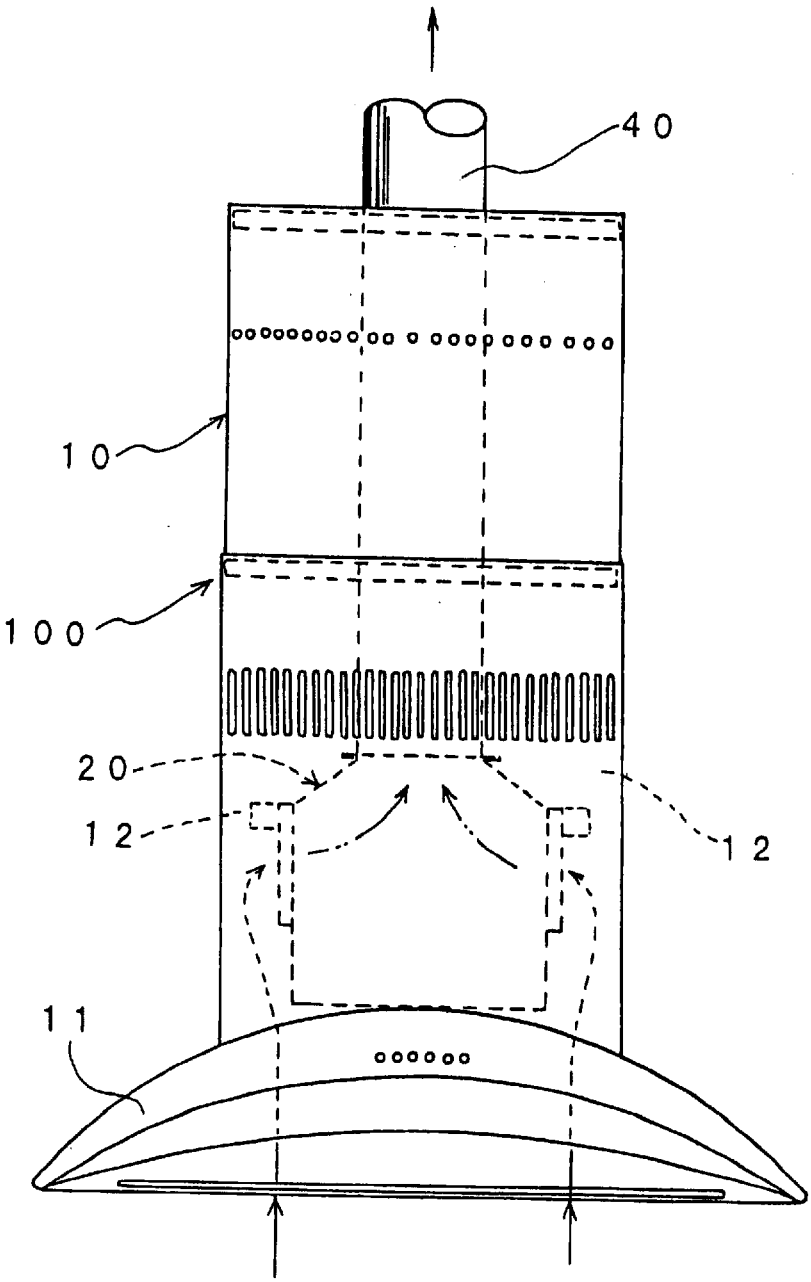
FIG. 6 is front view of an exhaust device according to another embodiment of the present invention.

In the foregoing another embodiment shown in FIG. 6, where the vent box 20 including the connection enclosure 20*a* is housed within a vent space 12 in the housing box 10, the exhaust opening 25 being in fluid communication with the bottom opening of the exhaust duct 40.

The partitions 21 with the tilted plates 22 provide a pair of vent routes 23 on their right and left respectively as explained, and together support a drive motor 31 of a drawer device 30 which is installed in the central axial portion of the vent box 20. Each tilted plate 22 extends in an orientation toward a central crossline of the opening of the exhaust duct 40 such that the fumed air sucked into the corresponding vent route 23 is naturally and reasonably directed toward the corresponding half of the exhaust duct opening 40 in cooperation with the corresponding tilted side wall of the connection enclosure 20*a*. The drive shafts 32 of the drive motor 31 of the drawer device 30 protrude to the left and right practically horizontally through the partitions 21 into the vent routes 23 as shown in FIG. 4.

The drawer device 30 has the drive motor 31 and a pair of sirocco fans 33 mounted on the drive shafts 32 of the drive motor 31 correspondingly. Each sirocco fan 33 is housed in the corresponding vent route 23. Each sirocco fan 33 has a number of blades 33*a*, the overall configuration of the blades 33*a* is a truncated cone converging from the corresponding suction openings 24 of the vent box 20 toward the drive motor 31, which effectively assists the air sucked by the sirocco fan 33 to smoothly flow into the corresponding vent route 23 without causing turbulence.

In the foregoing embodiments, the suction openings 24 are provided on the right and left side walls of the vent box 20, and the exhaust opening 25 connected with the exhaust duct 40 in fluid communication is provided on the top of the vent box 20, the remaining elements of the present invention being installed in position accordingly. However, it should be understood that various modifications and changes can be made to those embodiments, such as providing the drive shafts 32 of the drive motor 31 to protrude backward and forward within the vent box 20, or connecting the exhaust duct 40 to a side wall of the vent box 20.

Attachment

Reference for the numerals in the figures

100 exhaust device
10 housing box
11 range hood
12 vent space
20 vent box
21 partitions
22 tilted plate
23 vent routes
24 suction openings
25 exhaust opening
30 drawer device
31 drive motor
32 drive shafts
33 sirocco fans
33*a* blades
40 exhaust duct
200 system kitchen
210 gas range The present invention having been described, what is claimed is:

1. An exhaust device (100) to draw in fumed air produced from cooking on a cooking range (210) in a kitchen and to expel said fumed air into an exhaust duct (40), comprising:

a vent box (20) connected with said exhaust duct (40) in fluid communication therewith, which is installed in one of a range hood (11) and in a housing box (10) connected with a range hood (11) in fluid communication therewith; and a drawer device (30) housed in said vent box (20), wherein said vent box (20) includes a connection enclosure (20*a*) in an upper portion thereof in fluid communication with said exhaust duct (40) which converges toward said exhaust duct (40), wherein a pair of substantially vertical partitions (21) are provided within said vent box (20) on opposite sides from a longitudinal axis of said vent box (20), each having a tilted plate (22) extending toward a central crossline of an opening of said exhaust duct (40), to provide a pair of vent routes (23) together with side walls of said vent box (20), said vent routes (23) converging toward said exhaust duct (40), wherein said drawer device (30) comprises: a drive motor (31); a pair of drive shafts (32) protruding substantially horizontally in opposite directions from said drive motor (31) correspondingly into said vent routes (23) through said partitions (21); and a pair of sirocco fans (33) having blades (33*a*) correspondingly mounted on said drive shafts (32) in said vent routes (23), each set of said blades (33*a*) converging toward said drive motor (31).

2. An exhaust device as claimed in claim 1 wherein said motor is housed between two substantially vertical partitions extending in parallel to a centerline of said device, said partitions further including two angled plates extending from top edges of said partitions toward each other to meet at the centerline of the device.

3. An exhaust device as claimed in claim 2 wherein said vent box is larger than said exhaust duct.

4. An exhaust device as claimed in claim 3 wherein an angle of the pyramid transition member is equal to the angled plates atop the partitions.

5. An exhaust device as claimed in claim 1 wherein said device includes intake openings in said side walls of said vent box.

6. An exhaust device as claimed in claim 1 wherein said vent box includes an exhaust opening having a smaller dimension than said vent box.

7. An exhaust device comprising:

a hood;

a vent box in fluid connection with said hood;

an exhaust duct in fluid connection with said vent box;

a drawer device housed within said vent box, said drawer device including:

a motor located centrally in said device;

two drive shafts extending from and driven by said motor;

two truncated conical fans, located in divided flow routes, one mounted to each drive shaft, said fans being oriented such that said truncated conical shape converges toward said motor; said fans moving exhaust gas more quickly proximal to said motor and over a longer flow path and more slowly distal from said motor along a shorter flow path, said exhaust thereby maintaining a substantially equal speed along the longer and shorter paths, avoiding turbulence.

8. An exhaust device as claimed in claim 7 wherein said truncated conical fans are sirocco fans.

9. An exhaust device as claimed in claim 7 wherein said partitions divide said device into the two flow routes which are substantially similar and unobstructed.

10. An exhaust device as claimed in claim 7 wherein said two truncated fans are identical to each other.

11. An exhaust device to draw exhaust gasses from a cooking hood over a cooking apparatus and expel said gasses to a selected location comprising:

a bifurcated vent box in fluid communication with said cooking hood and said selected location;

at least one drive motor associated with said vent box;

two truncated conical fans each driven by said at least one motor, said truncated conical fans being adapted to accelerate exhaust gasses to differing degrees over the conical shape to accelerate gasses traveling over a longer flow path to a higher degree and accelerate gasses traveling over a shorter flow path to a lesser degree such that turbulence is avoided in said gasses.

* * * * *